US005964010A

United States Patent [19]

Huber

[11] Patent Number: 5,964,010

[45] Date of Patent: Oct. 12, 1999

[54] MOUNTING PLATE FOR A FURNITURE HINGE

[75] Inventor: Edgar Huber, Hard, Austria

[73] Assignee: Julius Blum Gesellschaft m.b.H., Hochst, U.S.S.R.

[21] Appl. No.: 08/968,520

[22] Filed: Nov. 12, 1997

[30] Foreign Application Priority Data

Nov. 13, 1996 [AT] Austria ..... 668/96

[51] Int. Cl.[6] ..... E05D 7/04

[52] U.S. Cl. ..... 16/237; 16/242; 16/246

[58] Field of Search ..... 16/237, 240, 239, 16/242, 245, 235, 246

[56] References Cited

U.S. PATENT DOCUMENTS

| | | | |
|---|---|---|---|
| 4,045,841 | 9/1977 | Rock et al. | 16/246 |
| 5,000,170 | 3/1991 | Young et al. | 16/239 |
| 5,257,437 | 11/1993 | Salice | 16/239 |

FOREIGN PATENT DOCUMENTS

| | | | |
|---|---|---|---|
| 346633 | 12/1989 | European Pat. Off. | 16/235 |
| 2686646 | 7/1993 | France | 16/245 |

*Primary Examiner*—Chuck Y. Mah
*Assistant Examiner*—Alison K. Pickard
*Attorney, Agent, or Firm*—Wenderoth, Lind & Ponack, L.L.P.

[57] ABSTRACT

A multi-member base plate assembly for mounting a hinge arm of a furniture hinge to a furniture side wall includes a mounting plate and a carrier plate. The hinge arm is fastenable to the carrier plate. The carrier plate is slidably mounted at the mounting plate and is adjustable in the direction of the height of the piece of furniture. The carrier plate has wing portions which in the mounted position of the base plate are mounted between the mounting plate and the furniture side wall. The mounting plate is formed of two separate leg portions connected to each other.

19 Claims, 7 Drawing Sheets

Fig. 9a
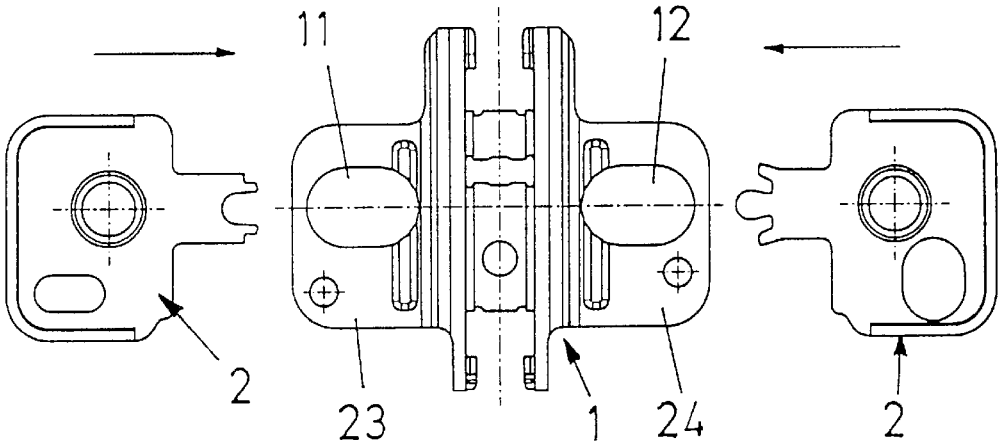
Fig. 9b
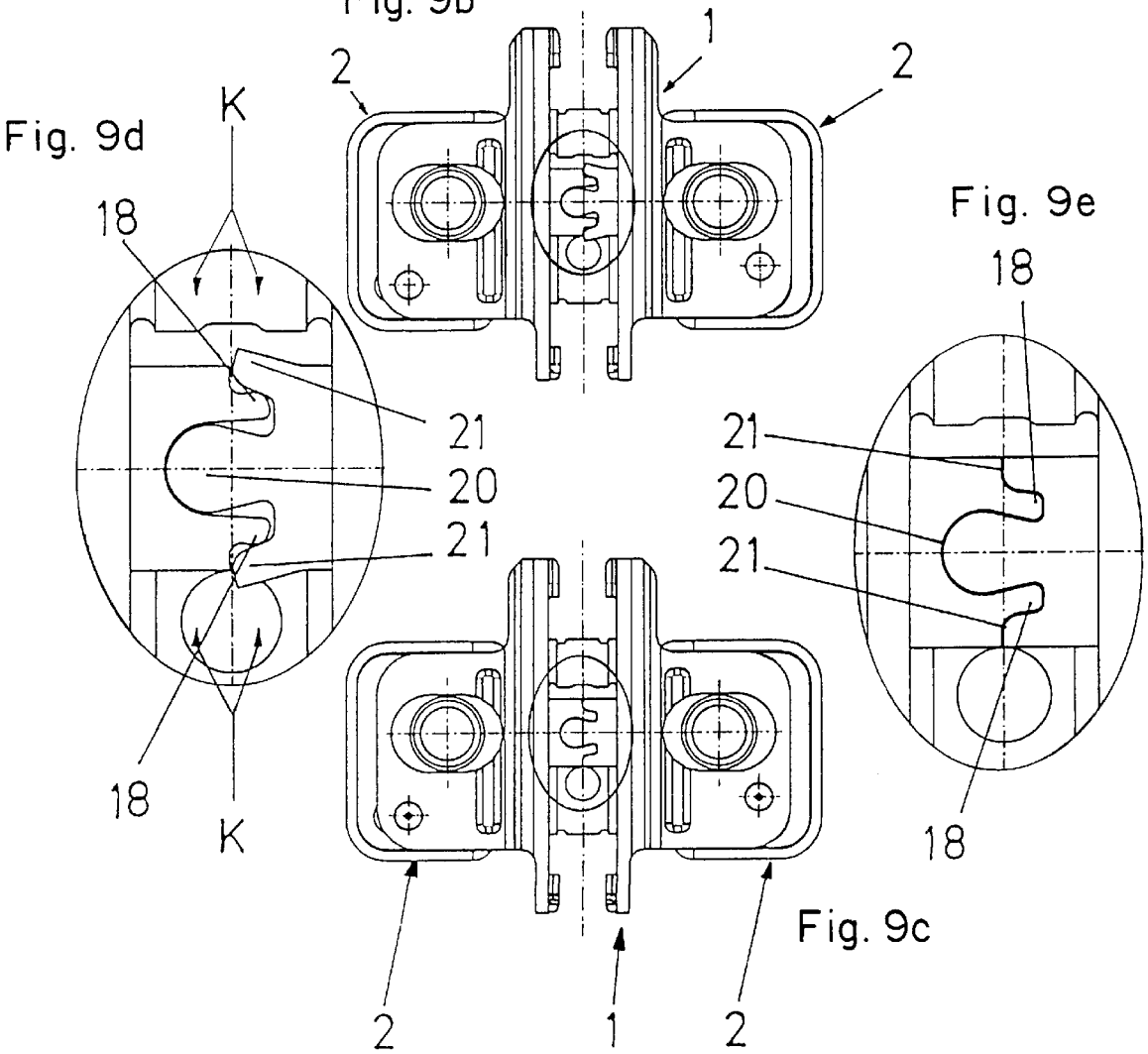
Fig. 9c

MOUNTING PLATE FOR A FURNITURE HINGE

BACKGROUND OF THE INVENTION

The present invention relates to a multi-member base plate assembly for mounting a hinge arm of a furniture hinge to a furniture side wall, the assembly comprising: a mounting plate adapted to be fastened to a furniture side wall; a carrier plate adjustably fastened to the mounting plate, the carrier plate including a protruding carrier part extending along a center axis of the carrier plate and having means for mounting thereon a hinge arm; the mounting plate having first and second leg portions extending transversely of the center axis on opposite sides thereof; and the carrier plate having first and second wing portions extending transversely of the center axis on opposite sides thereof.

It is a requirement of hinges in furniture constructions that the hinge arm which is connected with a hinge casing inserted in a furniture door by means of hinge links, can be fastened quickly and easily to a base plate which is fastened to a furniture side wall. It further should be possible to change and adjust the position of the hinge arm in order to overcome inaccuracies which may have been caused when drilling holes. It generally should be possible to adjust the position of the hinge arm in the direction of the height of the piece of furniture.

SUMMARY OF THE INVENTION

It is the object of the present invention to provide a base plate for easy adjustment of the hinge arm in the direction of the height of the piece of furniture and including carrier plate that is precisely guided on a mounting plate so that the carrier plate does not tilt or distort on the mounting plate under the weight of the door.

According to the present invention this is achieved by the first and second leg portions of the mounting plate each having a flap and the flaps being connectable with each other; the first and second leg portions of the mounting plate overlying the first and second wing portions of the carrier plate in the mounted position; the flaps passing through said protruding carrier part.

For easy assembly of the mounting plate and the carrier plate a preferred embodiment of the present invention provides that the flaps of the first and second leg portions are coupled to each other by means of projections that interlock with each other. It is further preferably provided that the projections extend and are moveable in a plane parallel to the leg portions and the wing portions in order to be coupled with each other.

In order to obtain a very narrow multi-member base plate a further preferred embodiment of the present invention provides that the carrier part is U-shaped in cross section with two lateral webs extending perpendicularly to the wing portions of the carrier plate, the lateral webs being provided with slots, the flaps of said first and second leg portions of the mounting plate extending through such.

To provide easy adjustment of the carrier plate, a preferred embodiment of the invention provides that the thickness of the wing portions of the carrier plate is less than the height of rims of the leg portions of the mounting plate, and that the two wing portions are provided with respective bulges on opposite sides of the carrier part, the bulges resting on the furniture side wall when in the mounted position, and the remaining parts of the wing portions being spaced from the furniture side wall.

Preferably the wing portions of the carrier plate are elastically bendable.

BRIEF DESCRIPTION OF THE DRAWINGS

In the following embodiments of the present invention will be described in greater detail with reference to the accompanying drawings without being limited thereto wherein:

FIGS. 9*a*–9*c* are bottom plan views of the base plate according to the present invention and FIGS. 9*d,* 9*e* are enlarged details of FIGS. 9*b,* 9*c,* respectively;

DETAILED DESCRIPTION OF THE INVENTION

Figure 1:
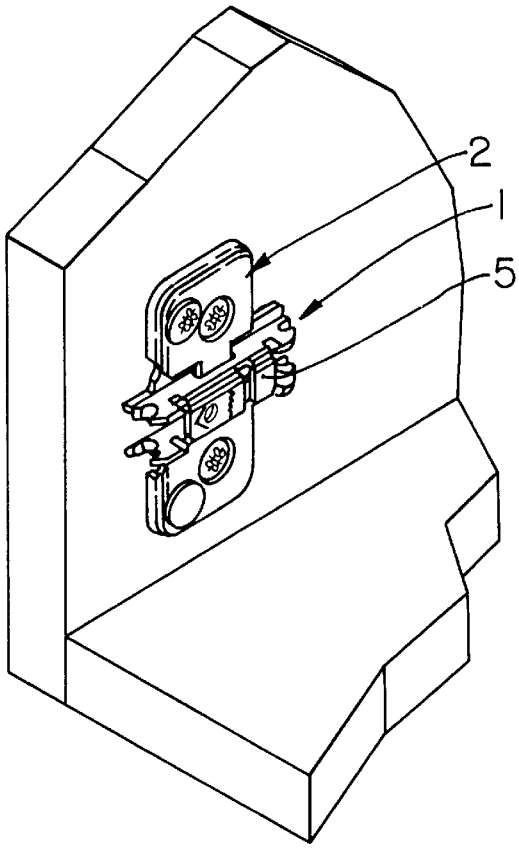
FIG. 1 is a perspective view of a base plate in accordance with the present invention mounted to a side wall of piece of furniture.
Figure 2:
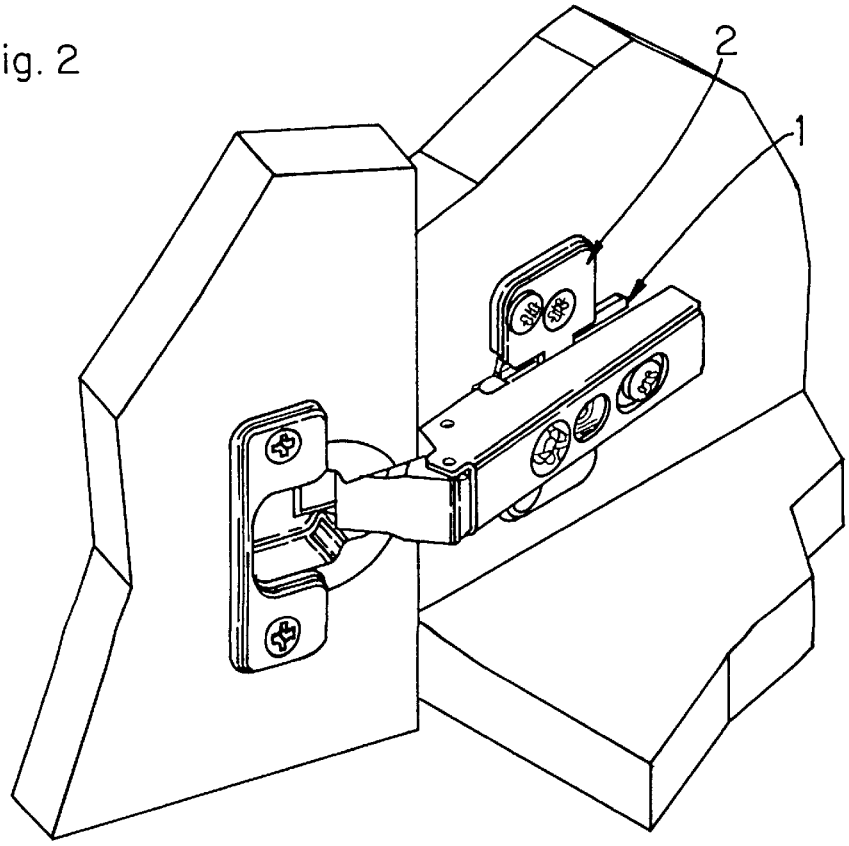
FIG. 2 is a perspective view of a hinge in an opened position the hinge being mounted on a base plate in accordance with the present invention.
Figure 3A:
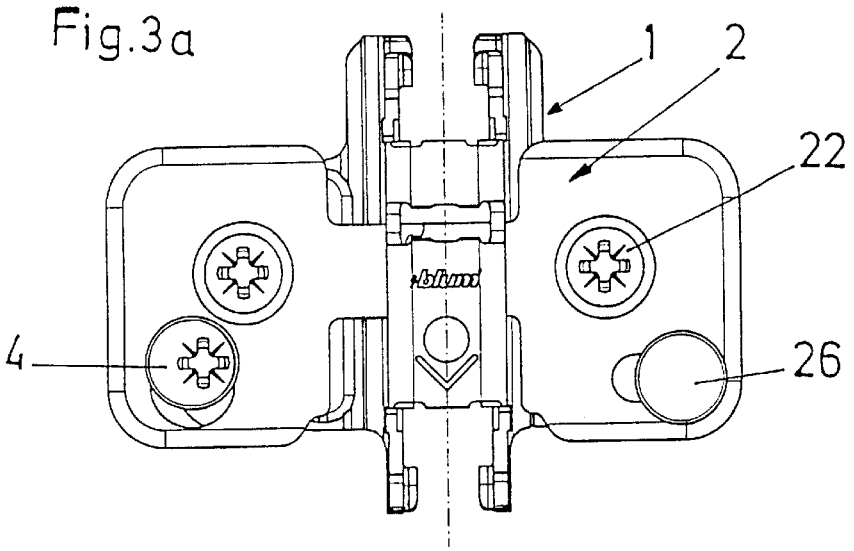
FIGS. 3*a*–3*c* are plan views of the base plate whereby different positions during height adjustment are shown.
Figure 3B:
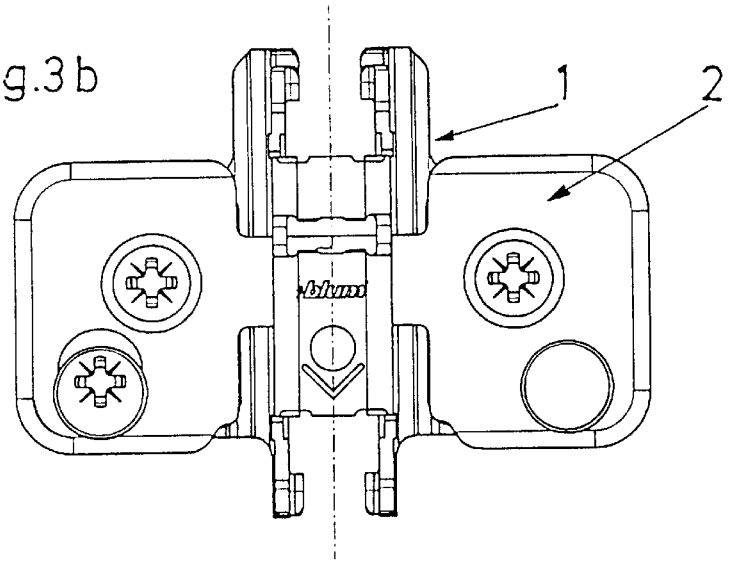
Figure 3C:
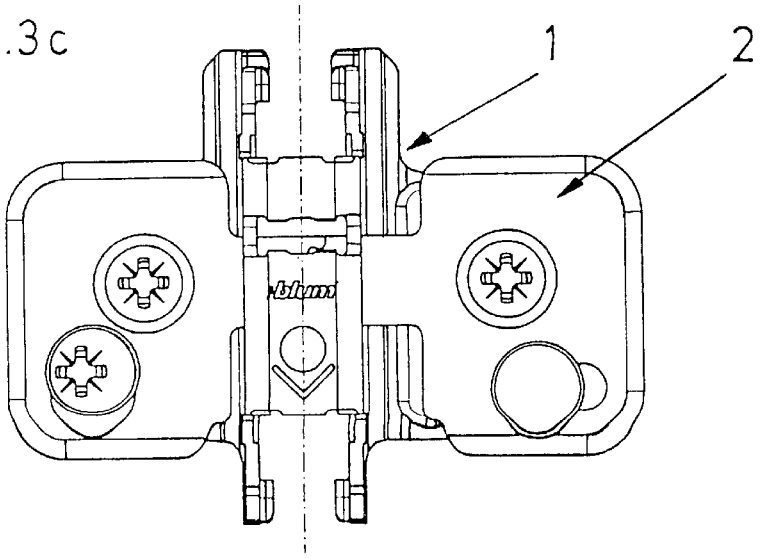
Figure 5:
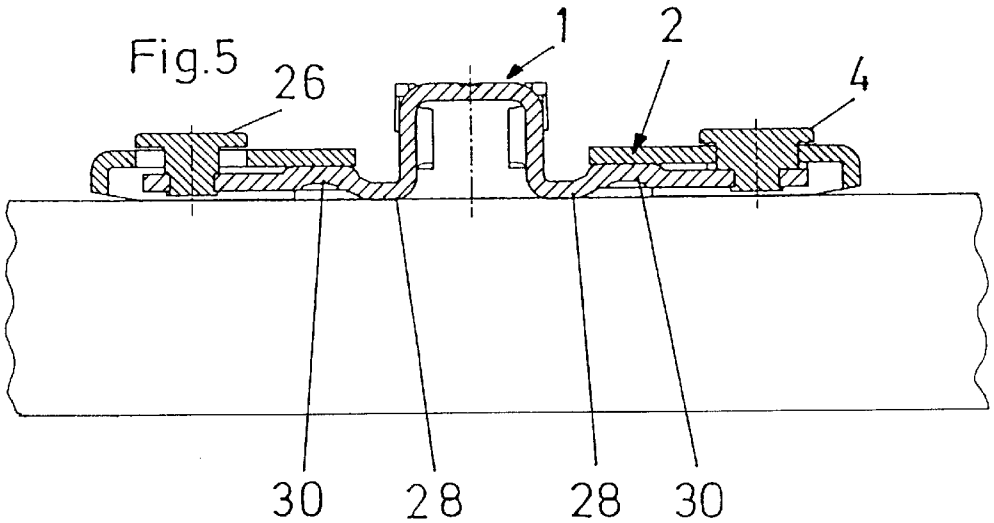
FIG. 5 is a sectional view taken along line V—V of FIG. 4.
Figure 6:
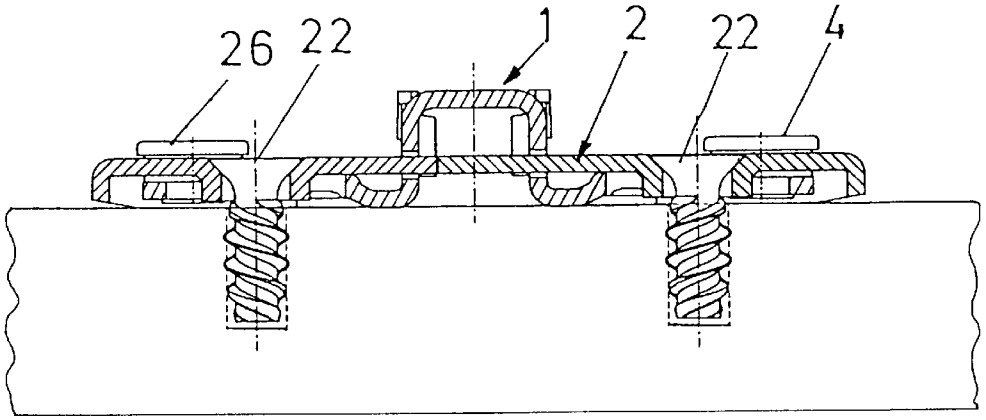
FIG. 6 is a sectional view taken along line VI—VI of FIG. 4.
Figure 4:
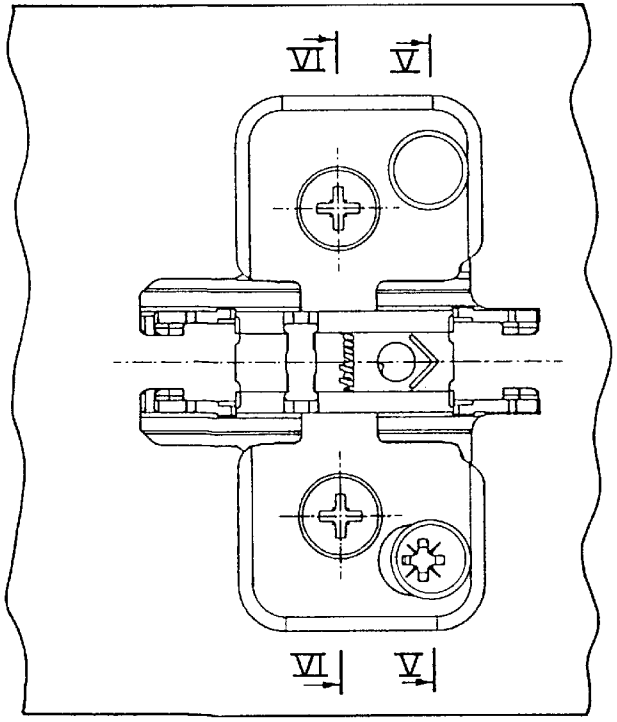
FIG. 4 is a further plan view of a base plate according to the present invention.
Figures 7, 8:
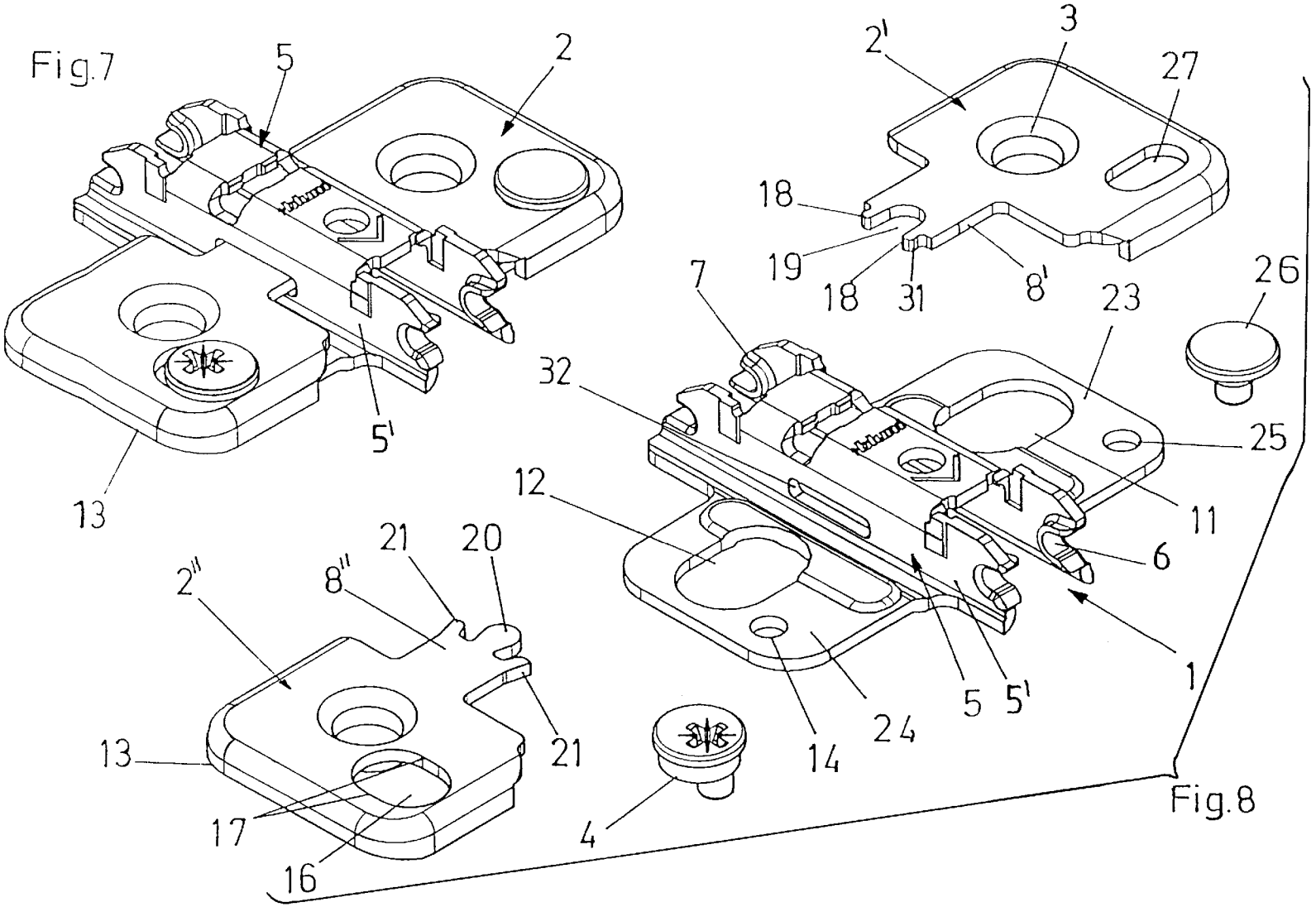
FIG. 7 is a perspective view of the base plate according to the present invention.
FIG. 8 is an exploded perspective view of the base plate according to the present invention.

A hinge arm may be anchored to a base plate in accordance to the present invention in the manner shown in European patent EP 225 609 B1. At the front end of a carrier part 5 protruding from carrier plate 1 are provided grooves in which a pin or protrusion of the hinge arm or an intermediate part carrying the hinge arm can be inserted. At the rear end the protruding carrier part 5 is provided with hook-like protrusions 7 with which engages a tilting lever which is mounted on the hinge arm or on the intermediate part carrying the hinge arm. Other modes of mounting the hinge arm to the base plate can also be utilized.

The base plate according to the present invention includes the carrier plate 1 carrying the hinge arm and mounting plate 2. The mounting plate 2 has holes 3 and the carrier plate 1 has longitudinal slots 11, 12. Fastening screws 22 by means of which the mounting plate 2 and the carrier plate 1 are securable to a side wall of a piece of furniture protrude through both the holes 3 and the longitudinal slots 11, 12.

The mounting plate 2 is formed of two separate parts, that is a first leg portion 2' and a second leg portion 2". The two leg portions 2', 2" are connected to each other by respective flaps 8', 8" that are joined to form passes through the protruding carrier part 5 of the carrier plate 1. The flap 8' of the first leg portion 2' at its free end is provided with two projections 18 provided at free ends thereof with protrusions 31. The corresponding flap 8" of the second leg portion 2" is provided with a central projection 20 and two lateral projections 21. The central projection 20 is tear-shaped in plan view. When assembling the base plate, the projections 18, 20, 21 are interlocked as shown in FIGS. 9*b* and 9*d*, whereby the central projection 20 is situated in a cut-out 19 of the flap 8'. Thereafter, the projections 18, 21 are clamped together by being moved in the plane of the mounting plate 2 in the directions of the arrows K in FIG. 9*d*. After such clampings the projections 18, 20, 21 are as shown in FIGS. 9*c* and 9*e*, and the leg portions 2', 2" of the mounting plate 2 thus are coupled to each other. The projections 18 are bent around the projection 20.

Because of the longitudinal slots 11, 12 in carrier plate 1, the fastening screws 22 are no obstacle when the position of the carrier plate 1 is adjusted.

The lateral webs 5' of the carrier part 5, which is U-shaped, are also provided with longitudinal slots 32 through which the flaps 8', 8" pass when the base plate is assembled. As the flaps 8', 8" pass through the carrier part 5 the base plate as a whole can be narrow.

The leg portions 2', 2" of the mounting plate 2 are provided with rims 13 which provide a guidance for the carrier plate 1. The rims 13 abut the side wall of the piece of furniture when in the mounted position and are pressed into the side wall of the piece of furniture when the fastening screws 22 are tightened. In the illustrated arrangement, rims 13 have a height h greater than the thickness b of the wing portions.

A wing portion 24 of the carrier plate 1 has a hole 14 in which is mounted an eccentric 4. The eccentric 4 extends through a longitudinal slot 16 in the leg portion 2" of the mounting plate 2 and is held between the stops in the form of rims 17 of longitudinal slot 16. By turning the eccentric 4 the position of the carrier plate 1 is adjustable with respect to the mounting plate 2 in the direction of the height of the piece of furniture. Another wing portion 23 of the carrier plate 1 is provided with a hole 25 in which fits a pin 26. The pin 26 extends through a longitudinal slot 27 in the leg portion 2' of the mounting plate 2. The pin 26 has a head portion which holds the leg portion 2' of the mounting plate 2 to the wing portion 23. The longitudinal slot 27 is aligned in the direction of the height of the piece of furniture so that the pin 26 does not inhibit height adjustment of the carrier plate 1. The pin 26 is necessary for holding the carrier plate 2 and the mounting plate 1 together before they are mounted on the side wall of the piece of furniture.

To facilitate adjustment of the carrier plate 1, opposite sides of the protruding carrier part 5 are provided with tub-like bulges 28. These bulges 28 rest on the furniture side wall when the base plate is mounted but the other parts of the wing portions 23, 24 are spaced from the furniture side wall.

As the carrier plate 1 is made out of steel the wing portions 23, 24 are elastic so that they can be bent towards the furniture side wall when the fastening screws 22 are tightened without jamming the carrier plate 1 with respect to the mounting plate 2.

Figure 10:
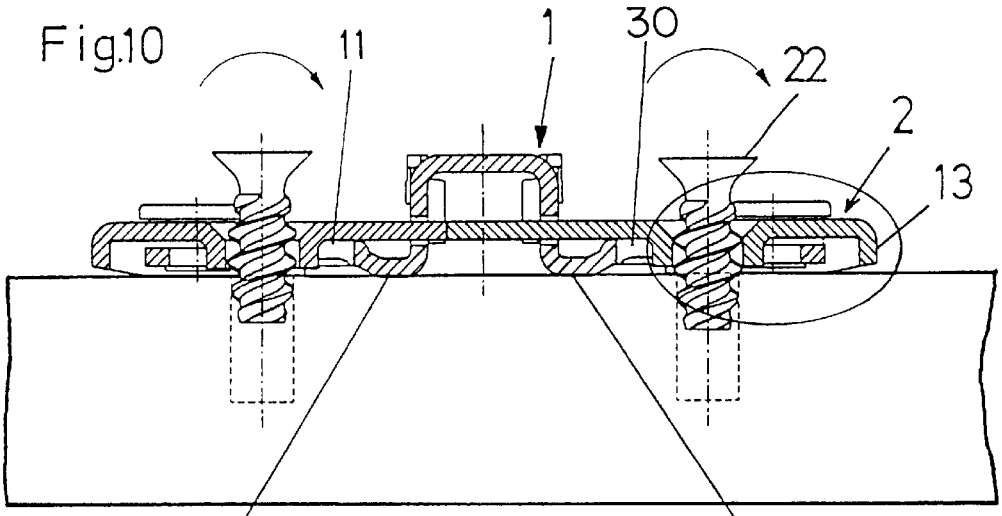
FIG. 10 is a sectional view taken along line VI—VI of FIG. 4 showing the base plate.
Figure 10A:
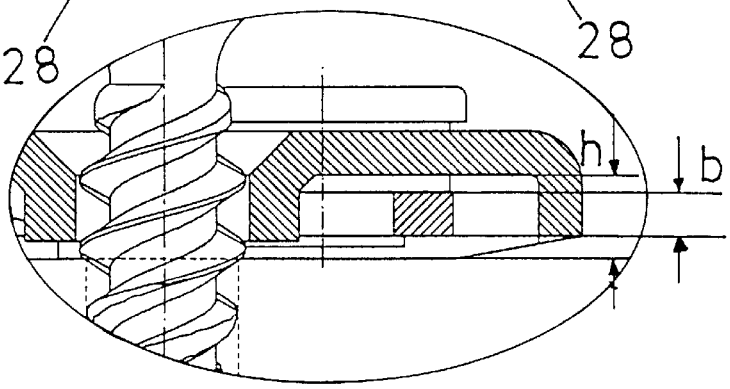
FIG. 10*a* is an enlarged detail thereof before fastening screws are tightened.
Figure 11:
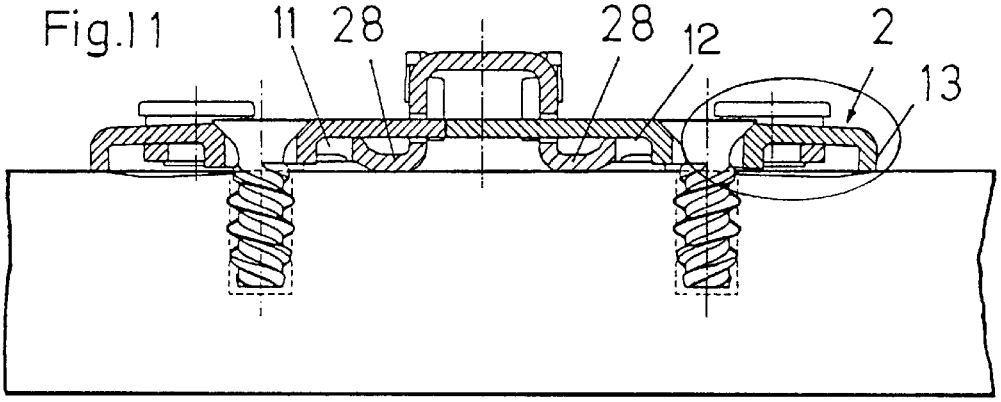
FIGS. 11 and 11*a* are views similar to FIGS. 10 and 10*a,* but with the fastening screws being tightened.
Figure 11A:
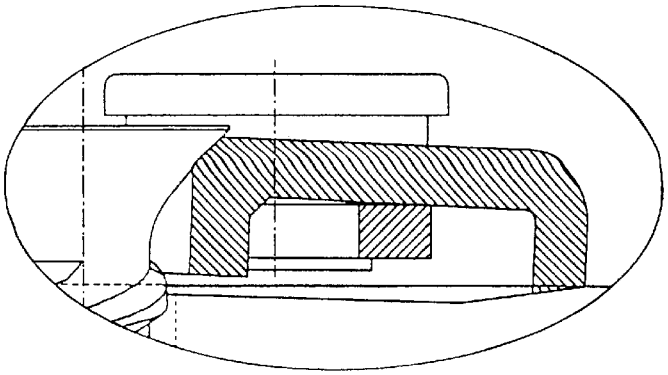
Figure 12:
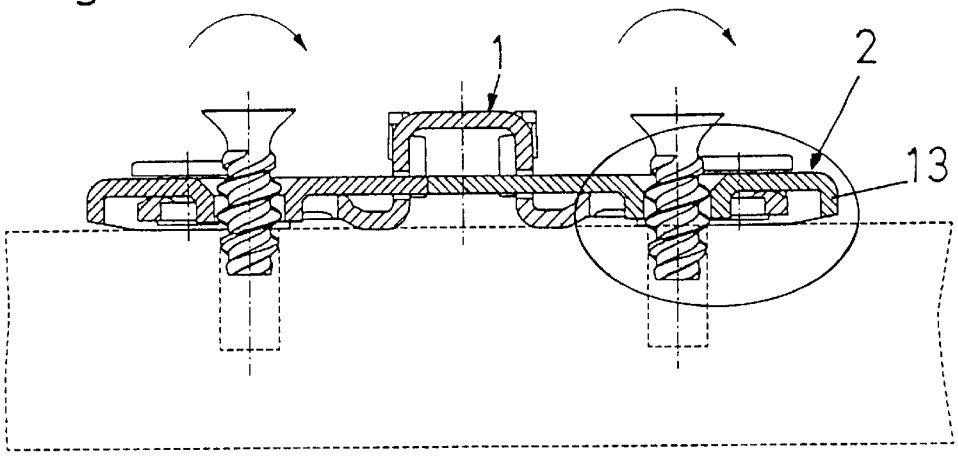
FIGS. 12–13*a* are views similar to FIGS. 10–11*a*, but according to a further embodiment of the invention.
Figure 12A:
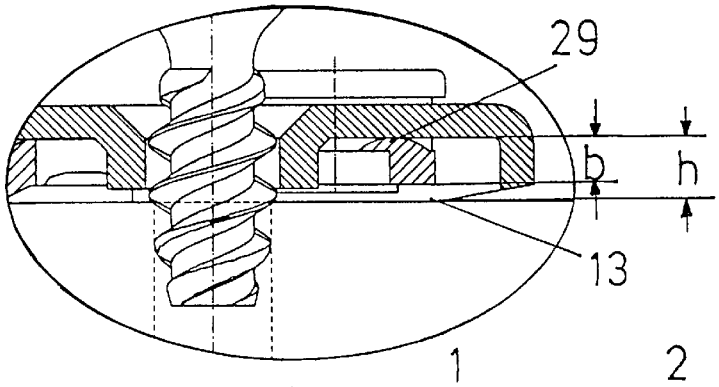
Figure 13:
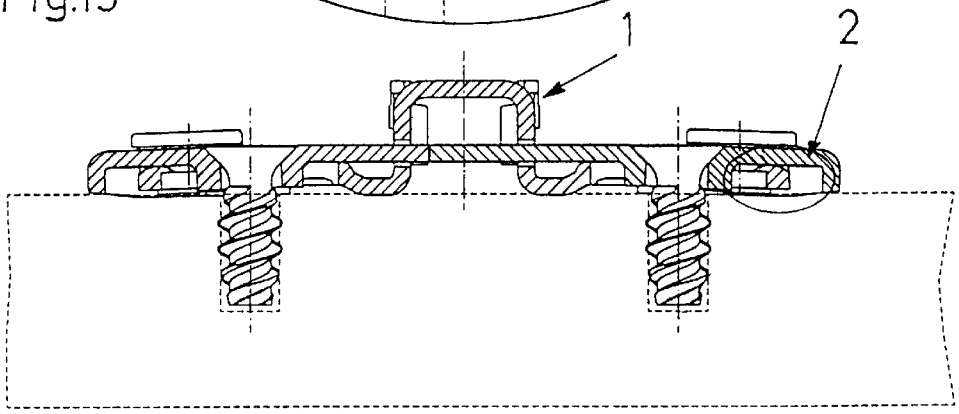
Figure 13A:
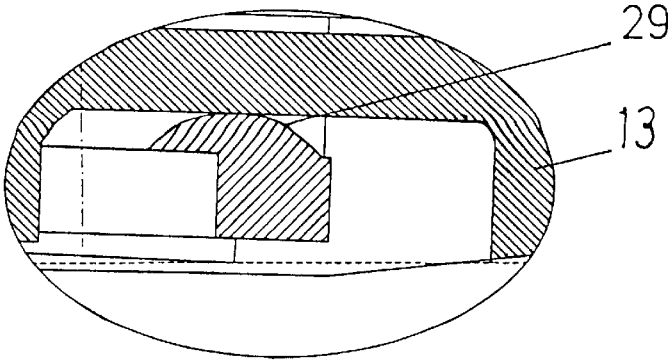

The adjustability of the position of the carrier plate 1 can be improved by providing the free ends of the wing portions 23, 24 with protrusions on ribs 29 or the like. These ribs 29 abut, as shown in FIGS. 10–11*a*, the mounting plate 2 and the area of contact between the carrier plate 1 and the mounting plate 2 is kept very small. This is especially important when the mounting plate 2 is bent slightly towards the furniture side wall when the fastening screws 22 are tightened.

With a base plate according to the invention the position of the carrier plate 1 is also adjustable when the rims 13 of the mounting plate 2 are pressed into the furniture side wall.

I claim:

1. A multi-member base plate assembly for mounting a hinge arm of a furniture hinge to a furniture side wall, said assembly comprising:

a mounting plate adapted to be fastened to the furniture side wall;

a carrier plate adapted to have mounted thereon the hinge arm, said carrier plate being adjustably fastened to said mounting plate in a mounted position, said carrier plate having a center axis and a protruding carrier part extending along said center axis;

said mounting plate including separate first and second leg portions extending transversely on opposite sides of said center axis in said mounted position of said carrier plate, and said carrier plate having first and second wing portions extending transversely on opposite sides of said center axis in said mounted position of said carrier plate; and said first and second leg portions of said mounting plate having respective flaps that are connectable with each other in a position such that said carrier part covers the thus connected said flaps and such that said first and second leg portions of said mounting plate overlie said first and second wing portions of said carrier plate in said mounted position thereof.

2. An assembly as claimed in claim 1, wherein said first and second leg portions of said mounting plate have respective rims to abut the furniture side wall, said first and second wing portions of said carrier plate being positioned within respective said rims.

3. An assembly as claimed in claim 2, wherein said rims have a height greater than a thickness of said wing portions.

4. An assembly as claimed in claim 1, wherein each of said first and second wing portions of said carrier plate is provided with a respective longitudinal slot elongated in a direction perpendicular to said carrier part.

5. An assembly as claimed in claim 1, wherein said carrier part has a U-shaped transverse cross-sectional configuration including two lateral webs extending transverse to respective said wing portions of said carrier plate, said lateral webs having respective slots, and said flaps of said first and second leg portions of said mounting plate extending through said slots.

6. An assembly as claimed in claim 1, further comprising an eccentric mounted on said carrier plate and positioned between stops of said mounting plate.

7. An assembly as claimed in claim 6, wherein said stops comprise spaced rim edges of a longitudinal slot formed in said mounting plate and extending parallel to said carrier part.

8. An assembly as claimed in claim 1, wherein said flaps of said first and second leg portions have respective projections that are interlockable with each other in a coupled position to connect said flaps with each other.

9. An assembly as claimed in claim 8, wherein said projections extend within a plane that is parallel to said leg portions and said wing portions, and said projections are movable within said plane to said coupled position.

10. An assembly as claimed in claim 8, wherein one said flap has three said projections, and the other said flap has two said projections.

11. An assembly as claimed in claim 10, wherein three projections of said one flap comprise a middle projection having a tear shape when viewed in plan and two lateral projections.

12. An assembly as claimed in claim 10, wherein said other flap has lateral protrusions.

13. An assembly as claimed in claim 11, wherein said first and second wing portions have respective bulges to abut the furniture side wall, with parts of said first and second wing portions other than said respective bulges being located at positions to be spaced from the furniture side wall.

14. An assembly as claimed in claim 13, wherein said bulges are tub-shaped.

15. An assembly as claimed in claim 13, wherein said wing portions of said carrier plate are elastically bendable.

16. An assembly as claimed in claim 13, wherein said wing portions of said carrier plate have at free ends thereof protrusions abutting said mounting plate.

17. An assembly as claimed in claim 16, wherein said protrusions are space further from said carrier part than said bulges.

18. An assembly as claimed in claim 1, further comprising a pin mounted on one said wing portion and extending into a slot formed in the respective overlying said leg portion, said slot extending perpendicular to said carrier part.

19. An assembly as claimed in claim 18, wherein said pin is fixed in a hole of said one wing portion and has a head overlying said respective overlying leg portion.

* * * * *